US011573515B2

(12) United States Patent
Miyahara et al.

(10) Patent No.: US 11,573,515 B2
(45) Date of Patent: Feb. 7, 2023

(54) FIXING MEMBER AND HEAT FIXING APPARATUS

(71) Applicant: CANON KABUSHIKI KAISHA, Tokyo (JP)

(72) Inventors: Yasuhiro Miyahara, Tokyo (JP); Matsutaka Maeda, Kanagawa (JP); Yuji Kitano, Kanagawa (JP); Makoto Souma, Kanagawa (JP); Yutaro Yoshida, Kanagawa (JP); Shigeo Kuroda, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/717,368

(22) Filed: Apr. 11, 2022

(65) Prior Publication Data

US 2022/0334522 A1 Oct. 20, 2022

(30) Foreign Application Priority Data

Apr. 19, 2021 (JP) ..... JP2021-070450
Mar. 15, 2022 (JP) ..... JP2022-039849

(51) Int. Cl.
*G03G 15/20* (2006.01)

(52) U.S. Cl.
CPC ..... *G03G 15/2057* (2013.01); *G03G 15/2017* (2013.01); *G03G 15/2053* (2013.01); *G03G 2215/2003* (2013.01); *G03G 2215/2016* (2013.01)

(58) Field of Classification Search
CPC ..... G03G 15/2017; G03G 15/2053; G03G 15/2057; G03G 2215/2003; G03G 2215/2016
See application file for complete search history.

(56) References Cited

U.S. PATENT DOCUMENTS

| | | | |
|---|---|---|---|
| 9,176,442 | B2 | 11/2015 | Nakayama et al. |
| 9,268,273 | B2 | 2/2016 | Miyahara et al. |
| 9,335,690 | B2 | 5/2016 | Asaka et al. |
| 9,367,009 | B2 | 6/2016 | Akiyama et al. |
| 9,891,565 | B1 | 2/2018 | Miyahara et al. |

(Continued)

FOREIGN PATENT DOCUMENTS

| | | |
|---|---|---|
| JP | 11-38826 A | 2/1999 |
| JP | 2015-127791 A | 7/2015 |

(Continued)

*Primary Examiner* — Joseph S Wong
(74) *Attorney, Agent, or Firm* — Venable LLP

(57) ABSTRACT

A fixing member for electrophotography having an endless shape has a base layer having an endless shape, and an elastic layer on the outer circumferential surface of the base layer. The elastic layer includes a silicone rubber and a filler dispersed in the silicone rubber. The total amount of the filler compounded in the elastic layer is 30 vol % or less based on the total volume of the elastic layer. The elastic layer satisfies the relation of λtd>λmd>λnd. λtd is a thermal conductivity of the elastic layer in the circumferential direction, λnd is a thermal conductivity of the elastic layer in the thickness direction, and λmd, is a thermal conductivity of the elastic layer in the longitudinal direction. λtd is 2.0 W/(m·K) or more, and λnd is 1.3 W/(m·K) or more.

8 Claims, 9 Drawing Sheets

(56) References Cited

U.S. PATENT DOCUMENTS

| | | | | |
|---|---|---|---|---|
| 10,228,644 | B2 | 3/2019 | Abe et al. | |
| 10,620,574 | B2 | 4/2020 | Kitano et al. | |
| 10,712,697 | B2 | 7/2020 | Maeda et al. | |
| 10,859,956 | B2 | 12/2020 | Maeda et al. | |
| 10,890,869 | B2 | 1/2021 | Miyahara et al. | |
| 11,137,707 | B2 | 10/2021 | Asaka et al. | |
| 2019/0235427 | A1* | 8/2019 | Mukoyama | G03G 15/2057 |
| 2019/0377290 | A1 | 12/2019 | Kitano et al. | |
| 2019/0377291 | A1 | 12/2019 | Maeda et al. | |
| 2020/0326649 | A1* | 10/2020 | Inagaki | G03G 15/2057 |
| 2020/0333737 | A1 | 10/2020 | Maeda et al. | |
| 2020/0371460 | A1 | 11/2020 | Miyahara et al. | |
| 2021/0373473 | A1* | 12/2021 | Lee | B32B 27/34 |

FOREIGN PATENT DOCUMENTS

| | | | |
|---|---|---|---|
| JP | 2018-124544 | A | 8/2018 |
| JP | 2018-205336 | A | 12/2018 |
| JP | 2019-120803 | A | 7/2019 |

* cited by examiner

FIXING MEMBER AND HEAT FIXING APPARATUS

BACKGROUND

Technical Field

The present disclosure relates to a fixing member and a heat fixing apparatus for use in an electrophotographic image forming apparatus such as a copier and a printer.

Description of the Related Art

Recently, due to enhanced needs for chromatic color images, an image forming apparatus that forms chromatic color images is also required to output uniform glossy images. Further, from the viewpoint of energy saving, high momentum for most effectively using energy consumed in a fixing apparatus is growing, and downsizing of an image forming apparatus is also required.

In order to provide uniform glossy images, as a fixing member of fixing apparatus, a constitution including an elastic layer containing heat-resistant silicone rubber disposed on a substrate made of metal or heat-resistant resin, and a coating or thin layer of fluorine resin formed thereon through an adhesive, is generally used.

Having an elastic layer, the fixing member follows the irregular shape of paper in a fixing nip, so that the heat and pressure can be uniformly applied to an unfixed toner image.

Further, the elastic layer of a fixing member is required to have high thermal conductivity as well as the elastic function from the viewpoint of saving energy. In general, desired thermal conductivity and elasticity are obtained by adding inorganic filler having high thermal conductivity as thermally conductive filler to heat-resistant rubber raw material such as silicone rubber. However, addition of a large amount of thermally conductive filler to achieve high thermal conductivity makes the elastic layer hardened, so that the elastic function may be lost. Further, due to repeating compression in a fixing nip, the number of spots at which local stress concentration occurs between the thermally conductive filler and the silicone rubber increases, so that the elastic layer may fracture under conditions with repeating large stress applied. Accordingly, a creative method for enhancing the thermal conductivity without increase in the amount of the thermally conductive filler added is required.

Since a fixing member gives heat to toner and recording material, the surface temperature thereof decreases along with passing of the recording material due to time lag of temperature control with a temperature control circuit. Accordingly, the heat quantity given to the recording material and toner from the fixing member at a leading end on the second cycle of the fixing member is smaller than that at a trailing end on the first cycle of the fixing member. As a result, on the image surface of the same recording material, the gloss of the image at the leading end on the second cycle of the fixing member decreases in comparison with the gloss of the image at the trailing end on the first cycle of the fixing member along the transport direction of the recording material, and steep gloss difference (gloss unevenness: hereinafter, referred to as gloss step) may occur on the image. That is, the temperature difference of the fixing member between the first cycle and the second cycle may become particularly large. In such a case, within one fixed image, a large gloss step may occur between an area which has been fixed with the trailing end of the fixing member on the first cycle thereof and an area which has been fixed with the leading end on the second cycle. In particular, smaller the size of the fixing member from the viewpoint of saving energy, shorter the circulation time of the fixing member, i.e.=circumference of fixing member/transport velocity,), the gloss step tends to stand out.

As a conventional technique for improving the aforementioned gloss difference of the fixing member between the first cycle and second cycle, in Japanese Patent Application Laid-Open No. H11-038826, a heat fixing apparatus for cooling the surface of a heat fixing member with a cooling unit before insertion of recording material is proposed. By lowering the temperature of the fixing member before insertion of recording material, the temperature difference of the fixing member between the trailing end on a first cycle and the leading end on a second cycle is reduced to reduce the gloss step.

Further, in Japanese Patent Application Laid-Open No. 2018-205336, a fixing unit having a thermally conductive sheet for conducting the heat from a heating member located inside a fixing member in the transport direction of recording material to reduce the difference in heat quantity in the transport direction of the recording material is disclosed.

According to our study, the heat fixing apparatus described in Japanese Patent Application Laid-Open No. H11-038826 is able to reduce the steep gloss step described above. However, in the heat fixing apparatus, the temperature of the fixing member once heated is lowered, the heat quantity given to the fixing member cannot be fully utilized. Further, the fixing unit described in Japanese Patent Application Laid-Open No. 2018-205336, the heat capacity of the fixing unit increases in an amount resulting from having the thermally conductive sheet, so that the more energy is required for heating the fixing unit to a predetermined temperature.

SUMMARY

At least one aspect of the present disclosure is directed to providing a fixing member for heat fixing apparatus capable of preventing occurrence of the gloss step in an electrophotographic image caused by temperature difference of the fixing member between a first cycle and a second cycle, while suppressing reduction in the usage efficiency of heat. Further, another aspect of the present disclosure is directed to providing a heat fixing apparatus capable of forming a high-quality electrophotographic image.

According to one aspect of the present disclosure, there is provided a fixing member for electrophotography having an endless shape including a base layer having an endless shape, and an elastic layer on the outer circumferential surface of the base layer. The elastic layer includes a silicone rubber and a filler dispersed in the silicone rubber. The content of the filler in the elastic layer is 30 vol % or less with respect to a volume of the elastic layer. The elastic layer satisfies a relation of $\lambda td>\lambda md>\lambda nd$, where $\lambda td$ is a thermal conductivity of the elastic layer in the circumferential direction, $\lambda nd$ is a thermal conductivity in the thickness direction, and $\lambda md$ is a thermal conductivity of the elastic layer in the longitudinal direction. Further, $\lambda td$ is 2.0 W/(m·K) or more, and $\lambda nd$ is 1.3 W/(m·K) or more.

Further, according to another aspect of the present disclosure, there is provided a heat fixing apparatus having a heating member and a pressurizing member disposed opposed to the heating member, wherein the heating member is the fixing member.

Further features of the present disclosure will become apparent from the following description of exemplary embodiments with reference to the attached drawings.

DESCRIPTION OF THE EMBODIMENTS

Figure 1:
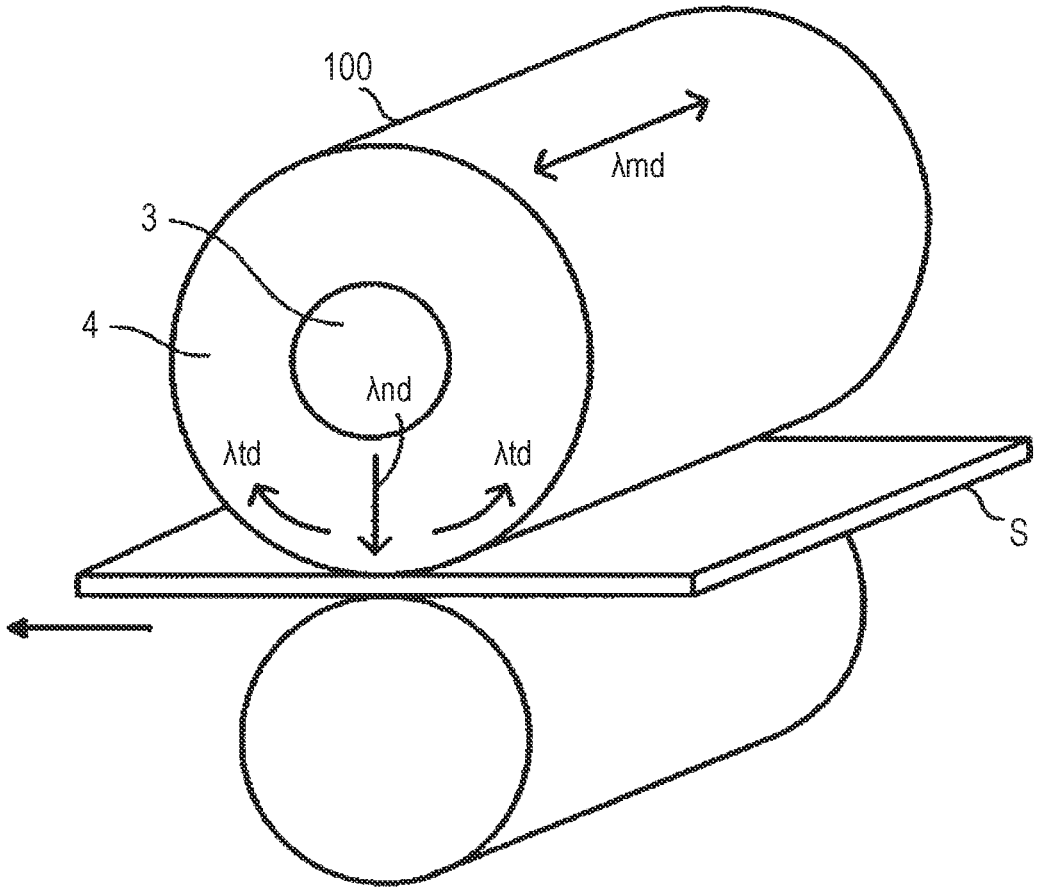
FIG. 1 is an illustrative drawing illustrating the direction of thermal conduction in an elastic layer of a fixing member in an aspect of the present disclosure.

Preferred embodiments of the present disclosure will now be described in detail in accordance with the accompanying drawings.

The present inventors have conducted repeated studies to achieve the directed fixing member, and the fixing apparatus. During the studies, we studied about a fixing member provided with an elastic layer containing a thermally conductive filler to enhance the thermal conductivity in the circumferential direction, such that to a portion having a lowered temperature due to removal of heat by the recording material, heat is supplied from upper stream and lower stream in the circumferential direction of the portion. Hereinafter, the thermal conductivity in the circumferential direction is also referred to as "λtd". In this case, although a large amount of the thermally conductive filler contained in the elastic layer may improve λtd, the large content of the thermally conductive filler results in increased hardness of the elastic layer. Thus, in order to suppress the increase in the hardness of the elastic layer, we have conducted further studies to realize an elastic layer whose content of the thermally conductive filler therein is 30 vol % or less with respect to the total volume of the elastic layer, whereas λtd is 2.0 W/(m·K) or more.

As a result, it has been found that use of a filler having tabular crystal structure such as hexagonal boron nitride is effective as a thermally conductive filler. Hexagonal boron nitride has a layered structure in which two-dimensional structures are alternately stacked, each of the two-dimensional structures including many six-membered rings with nitrogen and boron alternately bonded covalently are bonded in the plane direction. The thermal conductivity thereof in the plane direction is very high, for example, being 600 W/(m·K). Further, it has been found that due to having a tabular shape, hexagonal boron nitride contained in an elastic layer, with an orientation in the circumferential direction, allows λtd to be increased.

However, in the case where hexagonal boron nitride is oriented in the circumferential direction, the thermal conductivity in the thickness direction of an elastic layer is reduced, because hexagonal boron nitride has a very low thermal conductivity of about 3 W/(m·K) in the direction vertical to the crystal plane. Hereinafter, the thermal conductivity of the elastic layer in the thickness direction is also referred to as "λnd". In the case where a heat source is disposed on the rear face of a fixing member, the heat conduction to the surface of the fixing member is obstructed, which is not preferred for heat fixing of unfixed toner through effective use of heat.

Accordingly, through further studies, the present inventors have newly found the structure of an elastic layer capable of having both of a high λtd and a high λnd, with a suppressed content of thermally conductive filler of 30 vol % or less relative to the total volume of the elastic layer.

That is, the fixing member for electrophotography having an endless shape in an aspect of the present disclosure has a base layer in an endless shape and an elastic layer on the outer circumferential surface of the base layer. The elastic layer includes silicone rubber and fillers dispersed in the silicone rubber. The total amount of the fillers of the elastic layer is 30 vol % or less based on the total volume of the elastic layer. When the thermal conductivity of the elastic layer in the circumferential direction is represented by λtd, the thermal conductivity in the thickness direction by λnd, and the thermal conductivity in the longitudinal direction by λmd, the following relation is satisfied: λtd>λmd>λnd, wherein λtd is 2.0 W/(m·K) or more, and λnd is 1.3 W/(m·K) or more.

Due to a high λtd of 2.0 W/(m·K) or more, to a region where the surface temperature of a fixing member has been reduced resulting from passing of a recording material (a trailing end portion in a first cycle), heat is efficiently replenished from a region where no recording material has passed yet (a leading end portion in a second cycle). As a result, the temperature difference at a boundary portion of the fixing member between the first cycle and the second cycle can be reduced. Further, it can be presumed that due to a high λnd of 1.3 W/(m·K) or more, the resulting reduction in time required for conducting the heat generated from a heating source to the surface of the fixing member also has an effect for reducing the temperature difference.

The fixing member and the heat fixing apparatus in an embodiment of the present disclosure are described in detail based on specific structures.

(1) Schematic Structure of Fixing Member

The detail of the fixing member in the present embodiment is described with reference to drawings.

Figure 6A:
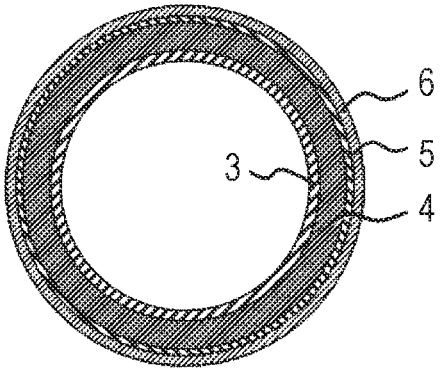
FIG. 6A is an illustrative view of a fixing member in an endless shape as an example in the present disclosure, illustrating a cross-section in parallel with the circumferential direction of the fixing member in an endless belt shape.
Figure 6B:
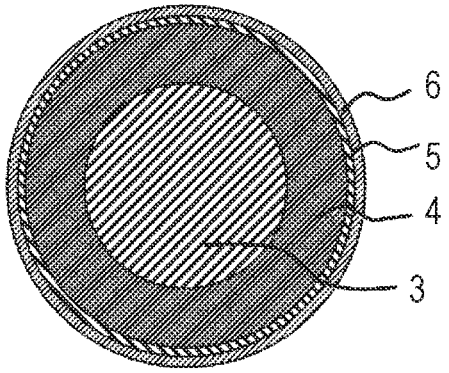
FIG. 6B is an illustrative view of a fixing member in an endless shape as an example in the present disclosure, illustrating a cross-section in parallel with the circumferential direction of the fixing member having a roller shape.

FIG. 6A and FIG. 6B are schematic cross-sectional views illustrating fixing members in the present embodiment. FIG. 6A illustrates a fixing member having a belt shape, and FIG. 6B illustrates a fixing member having a roller shape, as examples. In FIG. 6A and FIG. 6B, symbol 3 represents a substrate (base layer), and symbol 4 represents an elastic layer including silicone rubber covering the outer circumferential surface of the substrate 3. In FIG. 6A and FIG. 6B, the radial direction is the thickness direction of the elastic layer.

In this manner, the fixing member in the present embodiment has a substrate 3 and an elastic layer 4 including silicone rubber on the substrate 3. Incidentally, as illustrated in these drawings, the fixing member may have a surface layer 6 on the elastic layer 4 including silicone rubber. Further, the fixing member may have an adhesive layer 5 between the elastic layer 4 including silicone rubber and the surface layer 6, and in this case, the surface layer 6 is fixed to the outer circumferential surface of the elastic layer 4 including silicone rubber with the adhesive layer 5. Any of the fixing members illustrated in FIG. 6A and FIG. 6B has an endless shape. The endless shape is a shape that allows the same portion to pass through a fixing nip part many times (in an endless manner), due to rotational movement in the circumferential direction. Specific examples include an endless belt shape and a roller shape.

(2) Substrate

In the case where the fixing member has a belt shape as illustrated in FIG. 6A, metal such as electrocast nickel sleeve and stainless steel sleeve and heat-resistant resin such as polyimide may be used as the substrate 3. In particular, in the case where the heat fixing apparatus is of an electromagnetic induction heating-type, an alloy including nickel and iron as main components is used from the viewpoint of enhancing heat generation efficiency. On the outer face of the substrate 3 (face adjacent to the elastic layer), a layer for imparting functions to improve the adhesiveness to the elastic layer may be disposed. In other words, the elastic layer 4 may be provided on the outer circumferential surface of the substrate 3, and another layer may be disposed between the elastic layer 4 and the substrate 3. Further, on the inner face of the substrate 3 (face on the opposite side of the outer face), a layer for imparting abrasion resistance and lubricity may be further disposed. In the case of a belt shape, a core cylinder is inserted inside a sleeve during the following production step.

In the case where the fixing member is a fixing belt, it is preferable that the inner diameter of the fixing belt be 20 mm or more and 130 mm or less. With the inner diameter controlled in the range, restrictions on downsizing of a heater to be inserted and a heater holder are reduced and a fixing apparatus can be prevented from having an excessively large size.

In the case where the fixing member has a roller shape as illustrated in FIG. 6B, the substrate 3 may be an electroconductive core cylinder made of metal such as aluminum and iron or alloy (hereinafter, also referred to as core metal), having strength resistant to application of heat and pressure in a heat fixing apparatus. Although a solid core metal is used as substrate 3 in FIG. 6B, a hollow core metal may be used as substrate 3, with a heat source such as halogen lamp provided inside thereof.

(3) Elastic Layer

The elastic layer 4 includes a silicone rubber as binder, and fillers 7 dispersed in the silicone rubber. The content of the filler in the elastic layer is 30 vol % or less based on the volume of the elastic layer. When the thermal conductivity of the elastic layer 4 in the circumferential direction is represented by λtd, the thermal conductivity in the thickness direction by λnd, and the thermal conductivity in the direction orthogonal to the circumferential direction by λmd, the following relation is satisfied: λtd>λmd>λnd, wherein λtd is 2.0 W/(m·K) or more, and λnd is 1.3 W/(m·K) or more.

With a total content of the fillers in the elastic layer of 30 vol % or less based on the volume of the elastic layer, the rubber component in the elastic layer can be prevented from excessively decreasing. As a result, sufficient elasticity can be imparted to the elastic layer, and durability without causing fracture even after use for a long period can be also imparted. The tensile elastic modulus of the elastic layer is preferably 0.20 MPa or more and 1.20 MPa or less. With an elastic modulus of the elastic layer controlled within the range, the outer surface of the fixing member can well follow the irregular shape of paper, allowing a higher quality electrophotographic image to be formed. The elastic modulus of the elastic layer can be adjusted by the types and the amounts of the following individual components (a) to (d) compounded of addition curing liquid silicone rubber, in addition to by the content of fillers.

As described above, due to a high λtd of 2.0 W/(m·K) or more of the elastic layer of the present disclosure, to a region where the surface temperature of a fixing member has been reduced resulting from passing of a recording material (a trailing end portion in a first cycle), heat is efficiently replenished from a region where no recording material has passed yet (a leading end portion in a second cycle). As a result, the temperature difference at a boundary portion of the fixing member between the first cycle and the second cycle can be reduced. Further, it can be presumed that due to a high λnd of 1.3 W/(m·K) or more, the resulting reduction in time required for conducting the heat generated from a heating source to the surface of the fixing member also has an effect for reducing the temperature difference. Further, in the case where a heat source is disposed on the inner circumference side of the fixing member, the heat supplied to the fixing member from the heat source is efficiently transferred to the outer circumference side of the fixing member, so that use efficiency of heat for heat fixing of unfixed toner can be improved.

The thermal conductivity in the thickness direction λnd of the elastic layer may be calculated from the following equation (2). Further, the thermal conductivity in the width direction λmd of the elastic layer and the thermal conductivity in the circumferential direction λtd may be calculated from the following equation (3) and equation (4), respectively.

$$\lambda nd = \alpha_{nd} \times C_p \times \rho \qquad \text{Equation (2)}$$

wherein λnd represents thermal conductivity (W/(m·K)) in thickness direction of elastic layer, $\alpha_{nd}$ represents thermal diffusivity ($m^2/s$) in thickness direction of elastic layer, $C_p$ represents isobaric specific heat (J/(kg·K)), and ρ represents density ($kg/m^3$).

$$\lambda md=\alpha_{md}\times C_p\times\rho \quad \text{Equation (3)}$$

$$\lambda td=\alpha_{td}\times C_p\times\rho \quad \text{Equation (4)}$$

wherein $\alpha_{md}$ represents thermal diffusivity ($m^2/s$) in width direction, at represents thermal diffusivity ($m^2/s$) in circumferential direction, $C_p$ represents isobaric specific heat (J/(kg·K)), and ρ represents density ($kg/m^3$). The measurement method of each parameter is described in detail in Examples.

The elastic layer having the thermal properties described above in the present disclosure may be obtained, for example, by orientating fillers having a tabular crystal structure such as hexagonal boron nitride in the circumferential direction and thickness direction of the elastic layer. Such an elastic layer may be produced, for example, by the following method. On a substrate, a layer of composition for forming an elastic layer including a filler having a tubular crystal structure and a liquid silicone rubber (hereinafter, also referred to as "composition layer") is formed. On this occasion, since the fillers have a tubular crystal structure, the fillers tend to be oriented in a plane in the composition layer. In the case where the composition layer in the state is cured, an elastic layer having a large λtd and a small λnd is obtained.

Accordingly, the outer surface of the composition layer in a state with fillers oriented in a plane is charged. As a result, the fillers in the composition layer is dielectrically polarized to be oriented in the thickness direction. It is presumed that, in the process, the fillers are connected to each other to form a heat transfer pass in the circumferential direction. As a result, an elastic layer having a λtd of 2.0 W/(m·K) or more, and a λnd of 1.3 W/(m·K) or more can be prepared, with the following relation satisfied: λtd>λmd>λnd.

A supposed mechanism of the orientation of fillers due to charging of the outer surface of the composition layer, and the electrostatic charging method are described later.

The composition of the silicone rubber in the elastic layer can be identified by performing total reflection measurement (ATR) using infrared spectroscopic analyzer (FT-IR) (e.g., trade name: Frontier FT IR, manufactured by PerkinElmer). The silicon-oxygen bond (Si—O) as main chain structure of silicone has a strong infrared absorption in the vicinity of a wavenumber of 1020 $cm^{-1}$ due to stretching vibration. Further, since the methyl group bonded to a silicon atom ($Si—CH_3$) has a strong infrared absorption in the vicinity of a wavenumber of 1260 $cm^{-1}$ due to bending vibration derived from the structure, the presence thereof can be identified.

Further, the content of the cured silicone rubber and filler in the elastic layer can be identified by using a thermogravimetric analyzer (TGA) (e.g., trade name: TGA851, manufactured by Mettler-Toledo). About 20 mg of the elastic layer cut out with a razor or the like is accurately weighed and placed in an alumina pan to be used in the analyzer. The alumina pan with the sample put in is set in the analyzer, and heated from room temperature to 800° C. at a heating rate of 20° C. per minute under nitrogen atmosphere. Further, the temperature is kept at 800° C. for 1 hour. In the nitrogen atmosphere, along with temperature rise, the cured silicone rubber component is decomposed and removed by cracking without oxidation, so that the mass of the sample decreases. Accordingly, by comparison of the mass before and after the measurement, the content of the cured silicone rubber component and the content of filler in the elastic layer can be identified.

(3-1) Silicone Rubber

In the case where the fixing member is used as heating member, the elastic layer including silicone rubber functions as a layer for imparting excellent flexibility to follow the irregularities of paper during fixing. Due to having high heat resistance for keeping flexibility even in a high temperature environment at about 240° C. in a region without paper passing, silicone rubber is particularly suitably used as binder of the elastic layer. Further, it is preferable that the silicone rubber be electrically insulative or semiconductive, in order to impart electrical charges to the surface of the layer of composition for forming the surface layer for charging in an orientation step of fillers to be described later. Examples of the silicone rubber include a cured product of addition curing liquid silicone rubber.

(3-1-1) Addition Curing Liquid Silicone Rubber

An addition curing liquid silicone rubber may include an organopolysiloxane having an unsaturated aliphatic group (a), an organopolysiloxane having an active hydrogen bonded to silicon (b), a catalyst (e.g., platinum compound) (c), and a curing retarder (d).

The component (a) functions as a crosslinking point during curing reaction. The component (b) is a crosslinking agent. The component (c) is a catalyst for accelerating a curing reaction. The component (d) is a curing retarder (inhibitor) for controlling the reaction initiation time. In addition thereto, in order to impart heat resistance, reinforcement, etc., fillers suitable for individual objects may be kneaded or dispersed.

The components (a) to (d) are described as follows.

(3-1-2) Component (a)

As the organopolysiloxane having an unsaturated aliphatic group (hereinafter, also referred to as component (a)), any of organopolysiloxane having an unsaturated aliphatic group such as vinyl group may be used. For example, one represented by the following formula 1 and formula 2 may be used as component a.

A straight-chain organopolysiloxane having any one or both intermediate units selected from the group consisting of an intermediate unit represented by $R_1R_1SiO$ and an intermediate unit represented by $R_1R_2SiO$, and a molecular end represented by $R_1R_1R_2SiO_{1/2}$ (refer to the following formula 1).

formula 1

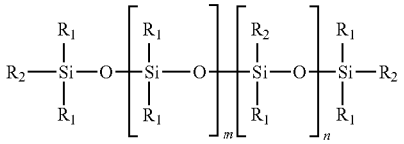

A straight-chain organopolysiloxane having any one or both intermediate units selected from the group consisting of an intermediate unit represented by $R_1R_1SiO$ and an intermediate unit represented by $R_1R_2SiO$, and a molecular end represented by $R_1R_1R_1SiO_{1/2}$ (refer to the following formula 2).

formula 2

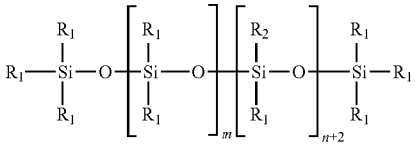

wherein $R_1$ each independently represent unsubstituted hydrocarbon groups containing no unsaturated aliphatic group, $R_2$ each independently represent unsaturated aliphatic groups, an m and n each independently represent integers of 0 or more.

Examples of the unsubstituted hydrocarbon group represented by $R_1$ in formula 1 and formula 2 containing no unsaturated aliphatic include a methyl group, an ethyl group, a propyl group, an aryl group (e.g., phenyl group). In particular, a methyl group is preferred.

Further, examples of the unsaturated aliphatic group represented by $R_2$ in formula 2 and formula 3 include a vinyl group, an allyl group ($CH_2$═CH—$CH_2$—) and 3-butenyl group, and a vinyl group is preferred.

In formula 1, the straight-chain organosiloxane with n=0 has unsaturated aliphatic groups at both ends only, and the straight-chain organosiloxane with n=1 or more has unsaturated aliphatic groups at both ends and in a side chain. The straight-chain organosiloxane in formula 2 has unsaturated aliphatic groups in a side chain only. As the component a, one type may be used alone, or two or more types may be used in combination.

In the case where the component (a) is used as raw material for silicone rubber, it is preferable that the viscosity be 100 $mm^2/s$ or more and 50000 $mm^2/s$ or less, from the viewpoint of obtaining excellent forming properties. The viscosity (dynamic viscosity) can be measured based on JIS Z 8803: 2011 by using a capillary viscometer, a rotational viscometer, or the like. In the case where a commercially available component a is used, catalog values may be referred to.

(3-1-3) Component (b)

The organopolysiloxane having an active hydrogen bonded to silicon is a crosslinking agent for forming a crosslinking structure by a reaction with an unsaturated aliphatic group in the component a through catalytic action of a platinum compound.

As the component (b), any of organopolysiloxane having an Si—H bond may be used, and, for example, one satisfying the following conditions may be suitably used.

Incidentally, as component b, one type of the component b may be used alone, or two or more types may be used in combination.

- From the viewpoint of acceleration of forming a crosslinking structure by a reaction with organopolysiloxane having an unsaturated aliphatic group, one having 3 or more hydrogen atoms bonded to a silicon atom on average in a molecule.
- Examples of the organic group bonded to a silicon atom may include the unsubstituted hydrocarbon group described above, and a methyl group is preferred.
- The siloxane skeleton (—Si—O—Si—) may be in a straight form, a branched form, or a ring form.
- The Si—H bond may be present in any siloxane unit in the molecule.

For example, a straight-chain organopolysiloxane shown in the following formula 3 and formula 4 may be used as component b.

formula 3

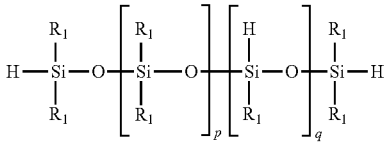

formula 4

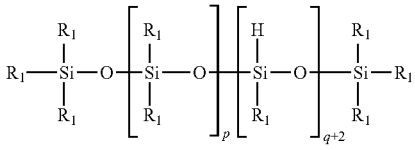

wherein $R_1$ each independently represent unsubstituted hydrocarbon group including no unsaturated aliphatic group, p represents an integer of 0 or more, and q represents an integer of 1 or more.

Incidentally, $R_1$ is an unsubstituted hydrocarbon group including no unsaturated aliphatic group as described in the formula 1 and formula 2, preferably being a methyl group.

(3-1-4) Component (c)

As catalyst for hydrosilylation (addition curing), for example, a platinum compound may be used. Specific examples include platinum carbonyl cyclovinylmethylsiloxane complex and platinum 1,3-divinyltetramethyldisiloxane complex. Hereinafter, the platinum compound is also referred to as component c.

(3-1-5) Component (d)

In order to control the curing reaction rate of hydrosilylation (addition curing), a curing retarder may be added. Specific examples thereof include 2-methyl-3-butyn-2-ol and 1-ethynyl-1-cyclohexanol. Herein after the curing retarder is also referred to as component d.

(3-2) Filler

A filler 7 in the elastic layer 4 functions for controlling the thermal conductivity of the elastic layer. In the present disclosure, it is preferable that a filler having a tabular crystal structure such as hexagonal boron nitride be used. For example, hexagonal boron nitride has a layered structure in which two-dimensional structures are alternately stacked, each of the two-dimensional structures including many six-membered rings with nitrogen and boron alternately bonded covalently are bonded in the plane direction. Further, the thermal conductivity of hexagonal boron nitride has anisotropy, being about 600 W/(m·K) in the plane direction and about 3 W/(m·K) in the direction vertical to the plane direction.

Figure 4A:
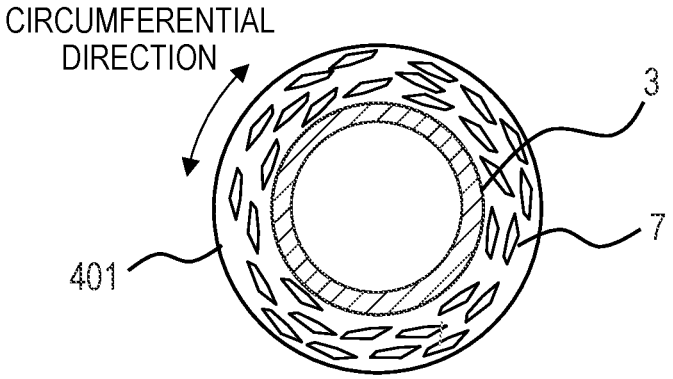
FIG. 4A is an illustrative view of a composition layer for forming an elastic layer before placed in an electric field, illustrating a cross-section in circumferential thickness direction.
Figure 4B:
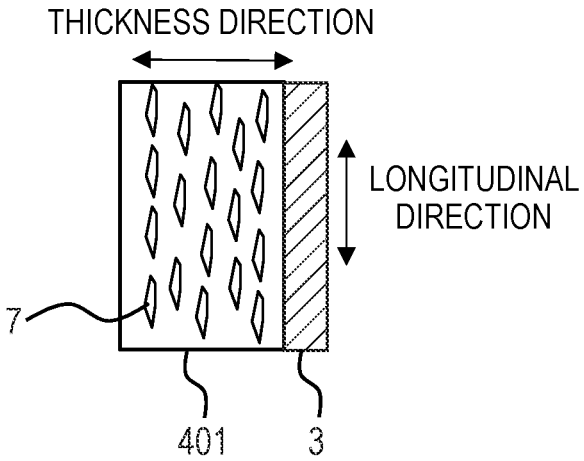
FIG. 4B is an illustrative view of a composition layer for forming an elastic layer before placed in an electric field, illustrating a cross-section in longitudinal thickness direction.

The case where a layer of the composition for forming an elastic layer including filler having a tabular crystal structure and silicone rubber raw materials is formed to obtain an elastic layer having a thickness of, for example, about 100 to 500 μm, is described as follows. The fillers tend to be oriented in the circumferential direction and the direction orthogonal to the circumferential direction (hereinafter, also referred to as "longitudinal direction") due to the tabular shape (hereinafter, also referred to "in-plane orientation"), as illustrated in FIG. 4A and FIG. 4B. As a result, λtd and λmd of the elastic layer obtained by curing the composition layer can be very high. On the other hand, due to the low thermal conductivity in the thickness direction of fillers having a tabular crystal direction, λnd of the elastic layer is very small.

Accordingly, in the present disclosure, it is preferable that the fillers be oriented in the thickness direction of the elastic layer in order to enhance λnd. The unrestricted production method of the elastic layer is described as follows with reference to FIG. 2A, FIG. 2B, FIG. 3A and FIG. 3B. The production method has the following steps (i) to (iii).

Step (i)

On the outer circumferential surface of the substrate 3, a layer of composition 401 (hereinafter, also referred to as "composition layer") for forming an elastic layer including thermally conductive fillers and silicone rubber raw materials (for example, the components (a), (b) and (c) described above) is formed.

Step (ii)

Figure 2A:
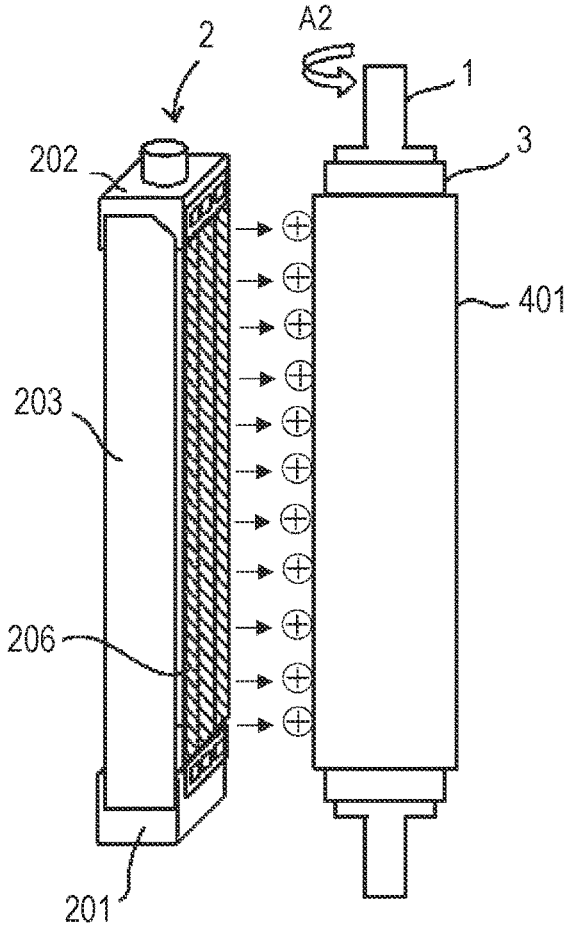
FIG. 2A is an illustrative overhead view of a charging step of a layer of the composition for forming an elastic layer in production method of the fixing member in an aspect of the present disclosure.
Figure 2B:
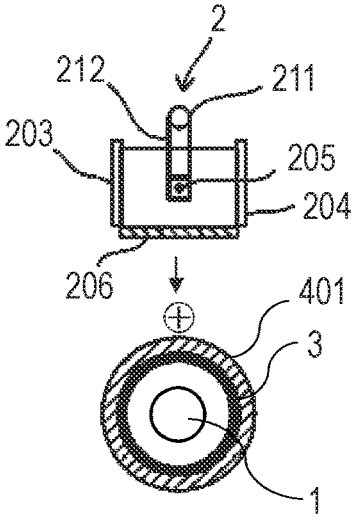
FIG. 2B is an illustrative cross-sectional view of a charging step of a layer of the composition for forming an elastic layer in production method of the fixing member in an aspect of the present disclosure.

While rotating the substrate 3 having the composition layer 401 in an arrow A2 direction, the surface of the composition layer is charged. In FIG. 2A and FIG. 2B, a positive charge is imparted, though not limited thereto. Alternatively, a negative charge may be imparted.

Figure 3A:
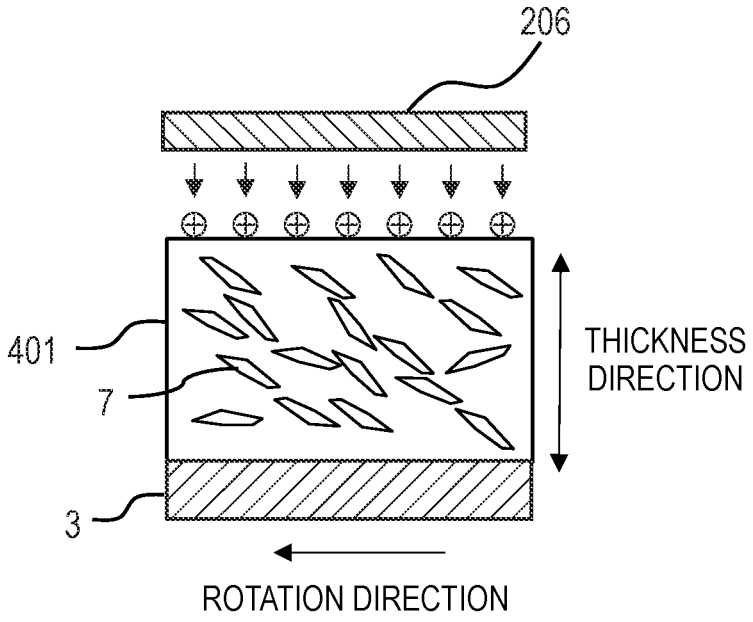
FIG. 3A is an illustrative view of orientation mechanism of fillers when a composition layer for forming an elastic layer is placed in an electric field, schematically illustrating an example of the orientation state of fillers in the cross-section in circumferential thickness direction.
Figure 3B:
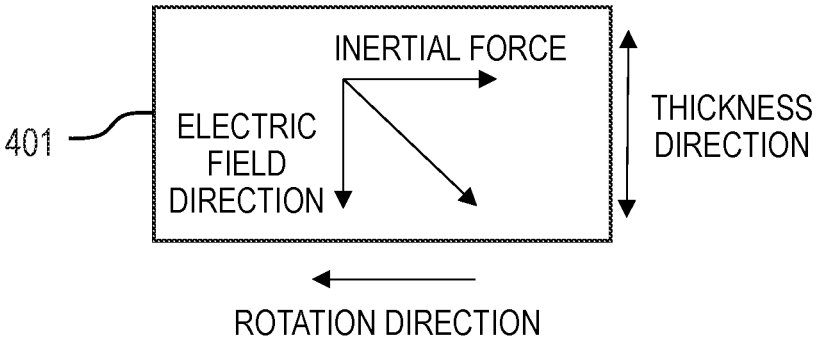
FIG. 3B is an illustrative view of orientation mechanism of fillers when a composition layer for forming an elastic layer is placed in an electric field, schematically illustrating a force applied to fillers.

In the composition layer with the surface charged, an electric field is formed in the thickness direction. Thereby, the fillers are dielectrically polarized, so that a rotational torque is generated in the electric field direction (thickness direction of composition layer) due to the polarized electric charges formed on the fillers. Further, due to rotation of the composition layer, as illustrated in FIG. 3A and FIG. 3B, a diagonal vector force as combination of a force in the electric field direction and an inertial force in the tangential direction (reverse direction to the rotational direction) relative to the film thickness is applied to the fillers 7 in the elastic layer 4. As a result, the fillers 7 that have been present in the state illustrated in FIG. 4A and FIG. 4B in the composition layer 401 before charging reach a state illustrated in FIG. 5A and FIG. 5B. Specifically, the longitudinal direction is oriented in the direction of a resultant force of the electric field force and the inertial force, and due to gradual moving of fillers in the composition layer caused by the charges that the fillers have, the state is changed such that the neighboring fillers are contacted to each other. As a result, λnd can be enhanced. It was originally supposed that due to the rotation of the fillers in the thickness direction of the composition layer 401, relative decrease in the thermal conductivity of the composition layer in the circumferential direction (λtd) occurs. However, the thermal conductivity in the circumferential direction λtd can be also increased probably due to formation of a heat transfer pass in the circumferential direction resulting from contact of neighboring fillers to each other along with the rotation of the fillers.

Step (iii)

Figure 5A:
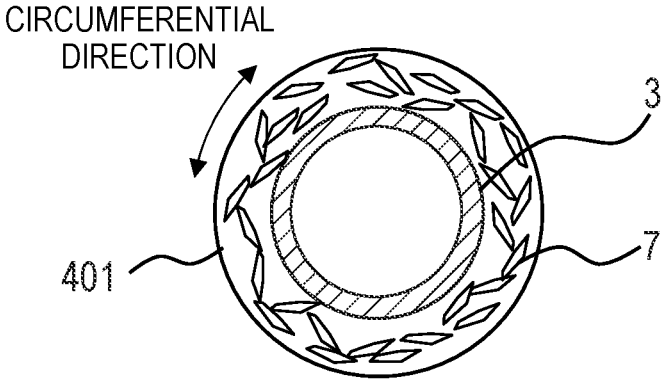
FIG. 5A is an illustrative view of a composition layer for forming an elastic layer when placed in an electric field with fillers oriented, illustrating a cross-section in circumferential thickness direction.
Figure 5B:
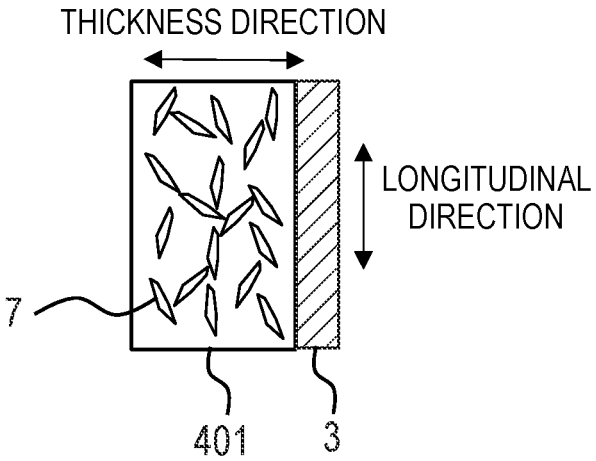
FIG. 5B is an illustrative view of a composition layer for forming an elastic layer when placed in an electric field with fillers oriented, illustrating a cross-section in longitudinal thickness direction.

The elastic layer in the present disclosure is formed by curing the composition layer with fillers being present in a state illustrated in FIG. 5A and FIG. 5B.

(3-3) Charging Method

In the step (ii) described above, as the method for charging the surface of the composition layer, a non-contact method is preferred, and a method using a corona charger capable of approximately uniform charging in a convenient manner at low cost is more preferred. Non-limiting examples of the charging method of the composition layer with use of a corona charger is described below with reference to FIG. 2A and FIG. 2B.

Examples of the corona charging method include a scorotron method having a grid electrode between a corona wire and an object to be charged, and a corotron method having no grid electrode. From the viewpoint of excellent control of the surface potential of the object to be charged, a scorotron method is preferred.

As illustrated in FIG. 2A and FIG. 2B, a corona charger 2 includes a front block 201, a back block 202, and shields 203 and 204. To an electric discharge wire 205 stretched between the front block 201 and the back block 202, a discharge bias is applied from a high voltage power source to cause electric discharge. As a result, the surface of the composition layer 401 on the substrate as an object to be charged is charged. Similar to a general corona charger structure, a high voltage is applied to the electric discharge wire 205 as discharge member. Through control of the ion current obtained by the discharge to the shields 203 and 204 by application of the high voltage to a grid 206, the surface of the composition layer 401 is charged to a predetermined potential. On this occasion, since the substrate 3 or a core cylinder 1 for holding the substrate 3 is grounded (not shown in drawing), a predetermined electric field can be generated in the composition layer 401 by controlling the surface potential of the surface of the composition layer 401.

An example of the production method of the elastic layer by using the corona charger 2 is described as follows. First, on the outer circumferential surface of the substrate 3, a composition layer is formed. The method for forming the composition layer is not particularly limited, and a known method such as a ring coating method and a blade coating method may be used. In particular, a ring coating method is suitably used because the fillers tend to be oriented in the in-plane direction of the composition layer.

Subsequently, the corona charger 2 is disposed opposite to and adjacent to the composition layer 401 along the width direction as illustrated in FIG. 2A. Then, a voltage is applied to the grid 206 of the corona charger 2, such that the surface of the composition layer is charged by rotating the substrate 3, for example, at 141 rpm for 160 seconds, in a discharge state. The distance between the surface of the composition layer 401 and the grid 206 may be set to 1 mm to 10 mm. By charging the surface of the composition layer 401 in such a manner, an electric field is generated in the composition layer 401. As a result of placing the composition layer in the electric field, by the rotational force caused by the dielectric polarization of the fillers and the inertial force along with the rotation, the fillers are oriented as illustrated in FIG. 5A and FIG. 5B. Then, the composition layer is cured by heating or the like to fix the orientation state of the fillers, so that the elastic layer in the present disclosure is formed.

The voltage applied to the grid 206 is preferably in the range of 0.6 kV to 3.0 kV in an absolute value (in the case of AC application, Vp-p (peak to peak voltage) of 1.2 kV to 6 kV), from the viewpoint of generating effective electrostatic interaction by fillers. In the case where the orientation of fillers is formed in the thickness direction of the elastic layer by using an electric field, it is important to generate the electric field in the thickness direction of the elastic layer 4. In the case where the plus or minus sign of the voltage applied is the same as the sign of the voltage applied to the wire, with any of minus and plus signs, the same effect is obtained, though the direction of the electric field is reversed. In the case where AC charging is performed to suppress the liquid level flow described below, it is preferable that the phases of the waveform of the wire and the grid be matched.

The orientation state of the fillers can be adjusted through control of the voltage applied to the grid 206. It is presumed that the dielectric constant of the silicone rubber and the dielectric constant of the filler are related to the orientation state. In the case where the difference between the dielectric constant of the silicone rubber and the dielectric constant of the filler is large, the fillers can be more significantly oriented even with a relatively small voltage applied. In the case the voltage applied to the grid 206 is too large, the electrostatic repelling force caused by the surface electric charge of the elastic layer increases to cause liquid level flow, which may result in degradation of the surface properties of the elastic layer 4. Accordingly, the voltage applied to the grid 206 is more preferably in the range of 0.6 kV to 1.5 kV in an absolute value (in the case of AC application, Vp-p (peak to peak voltage) of 1.2 kV to 3 kV). The liquid level flow can be reduced by AC charging.

The number of rotations of the substrate in the charging step in the step (ii) is not particularly limited, and the range of 10 rpm to 500 rpm is preferred as a guide. Further, the treatment time is set to preferably 20 seconds or more for surely charging the composition layers.

As the electric discharge wire 205, stainless steel, nickel, molybdenum, tungsten, etc., may be used, and it is preferable to use tungsten, which has very high stability among the metals. The electric discharge wire stretched inside the shields may be in a shape with a circular cross section or a saw-toothed shape. It is preferable that the diameter of the electric discharge wire 205 be 40 μm to 100 μm. The reason is that with a diameter of the electric discharge wire in the range, the cutting of the electric discharge wire by ions during discharging can be suppressed, and an excessively high voltage is unnecessary for generation of corona discharge. The voltage applied to the electric discharge wire 205 may be any one of a DC voltage or an AC voltage. In the case of AC voltage, the preferred frequency for performing the discharge is about 0.01 Hz to 1000 Hz. The voltage of square waveform, sine waveform, etc., may be outputted from an arbitrary waveform generator.

(3-4) Hexagonal Boron Nitride

Among thermally conductive fillers, hexagonal boron nitride has a low volume specific heat, so that the volume specific heat of the elastic layer can be reduced. Accordingly, use of hexagonal boron nitride is effective to reduce the warmup time of a fixing apparatus and save energy. Further, since hexagonal boron nitride has insulating properties, the composition layer also can maintain insulating properties, being suitable for imparting a high electric field by using a corona charger.

In the case of using hexagonal boron nitride as filler, the content of hexagonal boron nitride in the elastic layer is preferably 20 vol % or more and 25 vol % or less based on the total volume of the elastic layer.

With a content of 20 vol % or more, a sufficiently high thermal conductivity ($\lambda$td and $\lambda$nd) can be imparted to the elastic layer. With a content of 25 vol % or less, viscosity of the composition is prevented from increasing too high, so that the application of the composition layer and the orientation of the fillers when an electric field is applied are hardly obstructed.

The orientation state of the hexagonal boron nitride can be evaluated based on the diffraction intensity ratio which is calculated by substituting the diffraction intensity of (002) plane and the diffraction intensity of (100) plane obtained by X-ray diffraction (XRD) to the following equation.

Intensity ratio=I(100)/(I(100)+I(002))

I(100): diffraction intensity at $2\theta=41.6°$

I(002): diffraction intensity at $2\theta=26.7°$

The diffraction intensity ratio increases in proportion to the orientation of the fillers in the film thickness direction. A rubber layer cured in an uncharged state has a diffraction intensity ratio of 0.007, while the rubber layer cured after charging of the present disclosure has a diffraction intensity ratio of 1.222. Accordingly, it has been confirmed that the fillers oriented in the thickness direction increase due to influence of the charging.

In order to fill in the gap between the thermally conductive main fillers, thermally conductive sub fillers other than the thermally conductive main fillers may be blended for use. Examples of the thermally conductive sub fillers include alumina, zinc oxide, magnesium oxide, metal silicon, silicon carbide, silica and carbon. The thermally conductive fillers may be surface treated from the viewpoint of obtaining excellent affinity with silicone and excellent electric resistivity.

(4) Adhesive Layer of Fixing Member

AS illustrated in FIG. 6A and FIG. 6B, the adhesive layer 5 is a layer formed by bonding the elastic layer 4 to the surface layer (releasing layer) 6 with, for example, an addition curing silicone rubber adhesive. As adhesive, it is preferable to use an addition curing silicone rubber with a self-adhesive component compounded. Specifically, the adhesive contains an organopolysiloxane having a plurality of unsaturated aliphatic groups such as vinyl groups in the molecule chain, a hydrogen organopolysiloxane, and a platinum compound as crosslinking catalyst. Curing is caused through an addition reaction. A known adhesive may be used as the adhesive.

Examples of the self-adhesive component include the following.

- A silane having at least one, preferably two or more of functional groups selected from the group consisting of an alkenyl group such as vinyl group, a (meth)acryloxy group, a hydrosilyl group (SiH group), an epoxy group, an alkoxysilyl group, a carbonyl group and a phenyl group.
- An organic silicon compound such as cyclic or straight chain siloxane having 2 or more and 30 or less, preferably 4 or more and 20 or less silicon atoms.
- Non-silicon-based (i.e., containing no silicon atom in molecule) organic compound that may contain an oxygen atom in the molecule. The compound contains 1 or more and 4 or less, preferably 1 or more and 2 or less monovalent or more and tetravalent or less, preferably divalent or more and tetravalent or less aromatic rings such as phenylene structure in the molecule. Further, the compound contains at least one, preferably 2 or more and 4 or less functional groups capable of contributing to a hydrosilylation addition reaction (for example, an alkenyl group and a (meth)acryloxy group) in a molecule.

One type of the self-adhesive components may be used alone, or two or more types may be used in combination.

Into the adhesive, a filler component may be added within the spirit of the present disclosure, in order to control the viscosity and secure the heat resistance. Examples of the filler components include the following.

- Silica, alumina, iron oxide, titanium oxide, cerium oxide, cerium hydroxide, carbon black, etc.

Such addition curing silicone rubber adhesives are easily available from the market.

It is preferable that the thickness of the adhesive layer be 20 μm or less. With a thickness controlled to 20 μm or less, the thermal resistance of the fixing member can be reduced, so that the heat from the inside (substrate side) can be efficiently transferred to a recording material (recording medium).

(5) Surface Layer of Fixing Member

The surface layer 6 includes a fluorine resin. As the forming method, a tube method and a coating method is used. A tube method including coating with the following resin in a tube shape is described as example.

Tetrafluoroethylene-perfluoro(alkyl vinyl ether) copolymer (PFA), polytetrafluoroethylene (PTFE), tetrafluoroethylene-hexafluoropropylene copolymer (FEP), etc. Among the resin materials listed as examples, PFA is preferred from the viewpoints of excellent forming properties and toner releasability.

It is preferable that the thickness of the fluorine resin (surface layer) be 10 μm or more and 50 μm or less. The reason is that the abrasion resistance can be secured, while the elasticity of the elastic layer as lower layer when laminated can be maintained and the surface hardness of the fixing member is prevented from increasing too high.

The inner face of the fluorine resin tube may be subjected to sodium treatment, excimer laser treatment, ammonia treatment, or the like in advance to enhance the adhesion.

Figure 7:
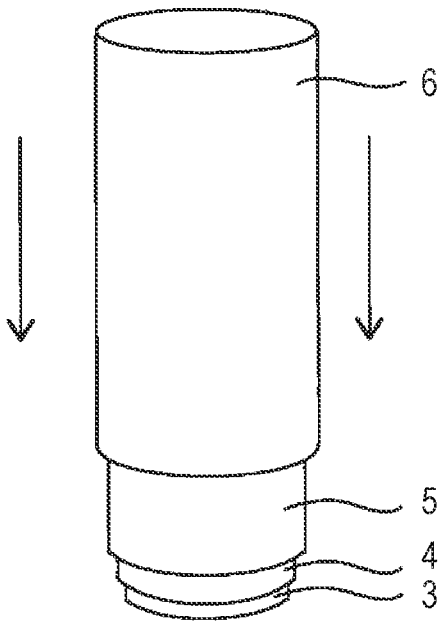
FIG. 7 is an illustrative view of the step of forming the surface layer in the production method of the fixing member in an aspect of the present disclosure.

FIG. 7 is an illustrative view of an example of the step of laminating the surface layer 6 on the elastic layer 4 including silicone rubber through the addition curing silicone rubber adhesive 5. On the surface of the elastic layer 4 formed on the outer circumferential surface of the substrate 3, the addition curing silicone rubber adhesive 5 is applied. Further, the outer face thereof is coated with the fluorine resin tube 6 as the surface layer 6 to make a laminate.

The coating method of a fluorine resin tube is not particularly limited, and a coating method with use of an addition curing silicone rubber adhesive as lubricant, and a coating method of expanding the fluorine resin tube from the outside may be used.

The surplus addition curing silicone rubber adhesive 5 remaining between the elastic layer 4 and the surface layer 6 including fluorine resin is removed by ironing out with a unit not shown in drawing. The thickness of the adhesive layer 5 after ironing out is preferably 20 μm or less from the viewpoint of obtaining excellent thermal conduction.

Subsequently, the addition curing silicone rubber adhesive 5 is cured and adhered by heating for a predetermined time with a heating unit such as electric furnace. Then, a fixing member having a desired length is obtained by cutting both ends in the width direction.

(6) Heat Fixing Apparatus

The heat fixing apparatus in the present embodiment includes rotating bodies such as a pair of a heated roller and a roller, a belt and a roller, and a belt and a belt that are pressure contacted to each other. The type of the heat fixing apparatus is appropriately selected based on the conditions such as a process rate and a size of the image forming apparatus as a whole on which the heat fixing apparatus is mounted.

In the heat fixing apparatus, a heated fixing member and a pressure applying member are pressure contacted to form a fixing nip N. A recording medium S to be heated, on which an image is formed from unfixed toner, is held and transported by the fixing nip N. The image formed from unfixed toner is referred to a toner image t. The toner image t is heated under pressure to cause melting and color mixing. The toner image t is then cooled, so that an image is fixed on the recording medium.

In the following, the structure of a specific example of heat fixing apparatus is described, though the scope and use of the present disclosure are not limited thereto.

(6-1) Fixing Belt-Pressurizing Belt Type Heat Fixing Apparatus

Figure 8:
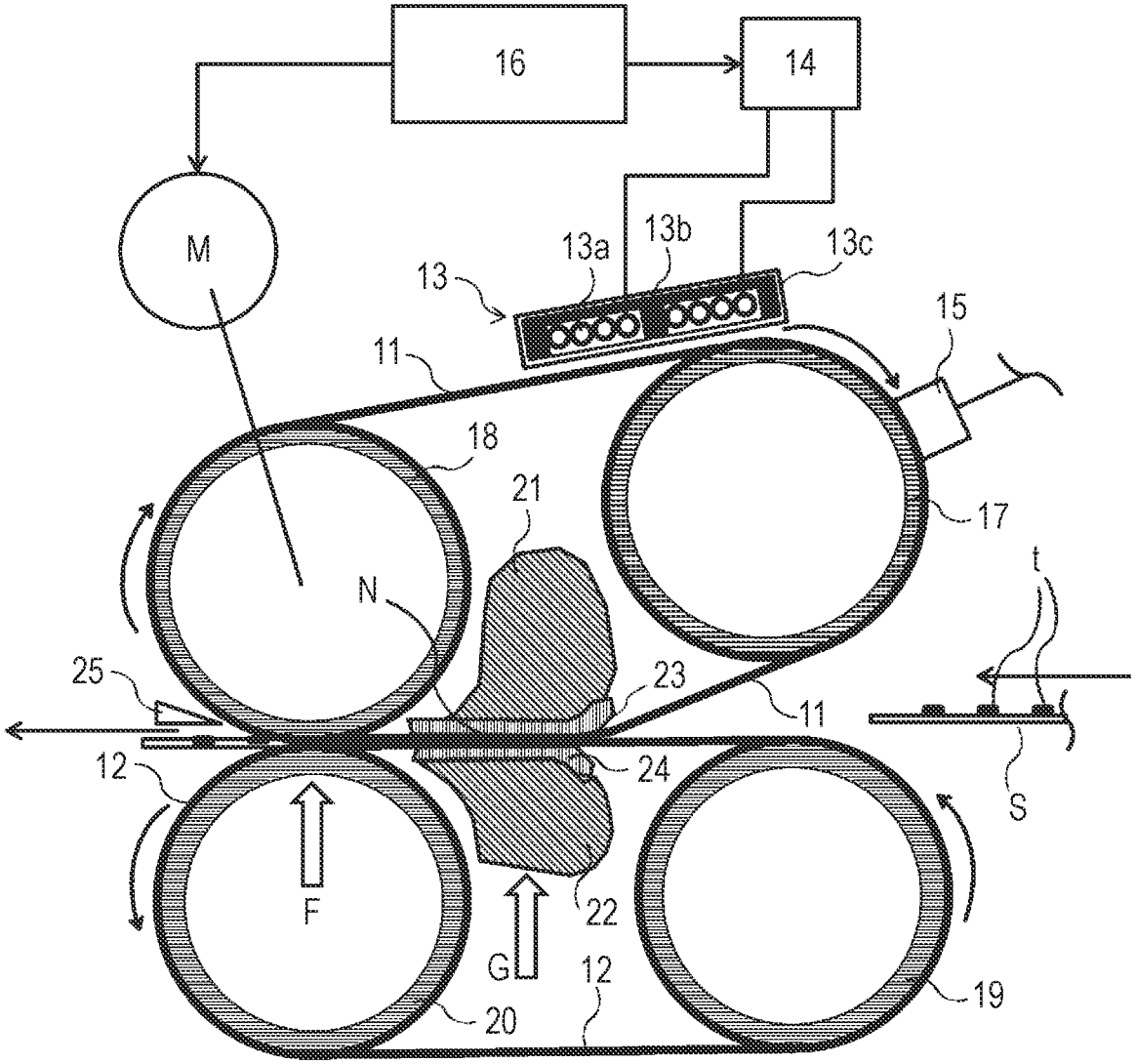
FIG. 8 is a cross-sectional view illustrating a heat fixing apparatus in an aspect of the present disclosure.

FIG. 8 is a schematic cross-sectional view illustrating an example of the heat fixing apparatus having a fixing belt as fixing member, which is a so-called twin belt type heat fixing apparatus having rotating bodies such as a pair of a fixing belt 11 and a pressurizing belt 12 that are pressure contacted.

The width direction of the heat fixing apparatus or the members included therein is the direction vertical to the sheet of FIG. 8. The front face of the heat fixing apparatus is the face on the introduction side of the recording medium S. References to right and left are when viewed from the front side of the apparatus. The width of a belt is the belt size in the right and left direction when viewed from the front of the apparatus. Further, the width of the recording medium S is the size of the recording medium S in the direction orthogonal to the transport direction of the recording medium S. Further, the upstream or downstream is the upstream or downstream in the transport direction of the recording medium S.

The heat fixing apparatus includes a fixing belt 11 and a pressurizing belt 12 as fixing members. The fixing belt 11 and the pressurizing belt 12 are fixing belts including a flexible metal substrate made of mainly nickel as illustrated in FIG. 6A, being stretched between two rollers.

As a heating unit of the fixing belt 11, a heating source that can perform heating by electromagnetic induction heating having high energy efficiency (induction heating member, exciting coil) is employed. An induction heating member 13 includes an induction coil 13*a*, an exciting core 13*b*, and a coil holder 13*c* that holds the coil and the core. The induction coil 13*a* made of flatly wound Litz wire in an oval shape is disposed in the exciting core 13*b* in a lateral E shape projecting at the center and both sides of the induction coil. The exciting core 13*b* made of ferrite or permalloy having high permeability and low residual magnetic flux density suppresses the loss in the induction coil 13*a* and the exciting core 13*b*, so that the fixing belt 11 can be efficiently heated.

When a high frequency current flows through the induction coil 13*a* of the induction heating member 13 from an exciting circuit 14, the substrate of the fixing belt 11 is induction heated, so that the fixing belt 11 is heated from the substrate side. The surface temperature of the fixing belt 11 is detected by a temperature detecting device 15 such as thermistor. The signal regarding the temperature of the fixing belt 11 detected by the temperature detecting device 15 is transmitted to a control circuit part 16. The control circuit part 16 controls the supplied power to the induction coil 13*a* from the exciting circuit 14, such that the temperature data received from the temperature detecting device 15 is maintained at a predetermined fixing temperature. As a result, the temperature of the fixing belt 11 is controlled at the predetermined fixing temperature.

The fixing belt 11 is stretched by a roller 17 as belt rotating member and a heating side roller 18. Each of the roller 17 and the heating side roller 18 is rotatably supported with a bearing between right and left side plates not shown in drawing of the apparatus.

The roller 17 is, for example, a hollow roller made of iron having an outer diameter of 20 mm, an inner diameter of 18 mm, and a thickness of 1 mm, which functions as a tension roller to stretch the fixing belt 11. The heating side roller 18 is an elastic roller having high slidability, including, for example, a core metal made of iron alloy having an outer diameter of 20 mm, an inner diameter of 18 mm, and a thickness of 1 mm, and a silicone rubber layer as elastic layer.

The heating side roller 18 as driving roller is rotary driven at a predetermined speed in the clockwise direction as shown by an arrow by the driving force inputted from a driving source (motor) M through a train of gears not shown in drawing.

Due to having the elastic layer, the heating side roller 18 can well transmit the driving force inputted to the heating side roller 18 to the fixing belt 11, and a fixing nip for securing separability of the recording medium from the fixing belt 11 can be formed. The heating side roller 18 having the elastic layer reduces the thermal conduction to the heating side roller, which has an effect for reducing the warmup time also.

The fixing belt 11 is rotated together with the roller 17 by friction between the surface of the silicon rubber surface of the heating side roller 18 and the inner face of the fixing belt 11, when the heating side roller 18 is rotary driven. The arrangement and the sizes of the roller 17 and the heating side roller 18 are selected in accordance with the size of the fixing belt 11. For example, the sizes of the roller 17 and the heating side roller 18 are selected such that the fixing belt 11 having an inner diameter of 55 mm in uninstalled state can be stretched.

The pressurizing belt 12 is stretched by a tension roller 19 and a pressurizing side roller 20 as belt rotating members. The inner diameter of the pressurizing belt in uninstalled state is, for example, 55 mm. Similar to the roller 17 and the heating side roller 18, each of the tension roller 19 and the pressurizing side roller 20 is rotatably supported with a bearing between right and left side plates not shown in drawing of the apparatus.

The tension roller 19 includes, for example, a core metal made of iron alloy having an outer diameter of 20 mm, an inner diameter of 16 mm, and a thickness of 2 mm, with a silicone sponge layer having a small thermal conductivity disposed thereon in order to reduce thermal conduction from the pressurizing belt 12.

The pressurizing side roller 20 is a rigid roller having low slidability made of iron alloy, for example, with an outer diameter of 20 mm, an inner diameter of 16 mm, and a thickness of 2 mm. In a similar manner, the sizes of the tension rollers 19 and the pressurizing side roller 20 are selected in accordance with the size of the pressurizing belt 12.

In order to form a nip part N between the fixing belt 11 and the pressurizing belt 12, the pressurizing side roller 20 is pressurized at both of the right and left sides of the rotation axis toward the heating side roller 18 by a predetermined pressurizing force in the direction of an arrow F through a pressurizing mechanism not shown in drawing.

In order to obtain a wide nip part N without increase in size of the apparatus, pressurizing pads are employed. In other words, a fixing pad 21 as first pressurizing pad applies pressure to the fixing belt 11 toward the pressurizing belt 12, and a pressurizing pad 22 as second pressurizing pad applies pressure to the pressurizing belt 12 toward the fixing belt 11. The fixing pad 21 and the pressurizing pad 22 are supported and disposed between the right and left side plates of the apparatus not shown in drawing. The pressurizing pad 22 is pressurized toward the fixing pad 21 with a predetermined pressurizing force in the direction of an arrow G by a pressurizing mechanism not shown in drawing. The fixing pad 21 as the first pressurizing pad has a pad substrate and a sliding sheet (low-friction sheet) 23 in contact with the belt. The pressurizing pad 22 as the second pressurizing pad also has a pad substrate and a sliding sheet 24 in contact with the belt. The reason is that there exists a problem of increased scraping at a portion of the pad rubbed with the inner circumferential surface of the belt. The sliding sheet 23 and the sliding sheet 24 lying between the belt and the pad substrate suppresses the scraping of the pad and reduces the sliding resistance, so that excellent belt travelling and durability of the belt can be secured.

The fixing belt is provided with a non-contact type anti-static brush (not shown in drawing), and the pressurizing belt is provided with a contact-type anti-static brush (not shown in drawing), respectively.

A control circuit part 16 drives a motor M at least when the image is formed. Thereby, the heating side roller 18 is rotary driven, and the fixing belt 11 is rotary driven in the same direction. The pressurizing belt 12 rotates to follow the fixing belt 11. The structure that transports the most downstream part of the fixing nip with the fixing belt 11 and the pressurizing belt 12 put between a roller couple of the heating side roller 18 and the pressurizing side roller 20 can prevent the slippage of the belts. The most downstream part of the fixing nip is the part having the maximum pressure distribution of the fixing nip in the transport direction of the recording medium.

When the fixing belt 11 is heated to a predetermined fixing temperature and maintained at the temperature (referred to as temperature control), a recording medium S having an unfixed toner image t is transported to the nip portion N between the fixing belt 11 and the pressurizing belt 12. The recording medium S is introduced with the face on which the unfixed toner image t is supported facing the fixing belt 11. The unfixed toner image t of the recording medium S adhered to the outer circumferential surface of the fixing belt 11 is held and transported directly. Thereby, heat is imparted to the unfixed toner image from the fixing belt 11, and image is fixed to the surface of the recording medium S with the pressurizing force. On this occasion, the heat of the fixing belt 11 from the heated substrate is efficiently transported toward the recording medium S through the elastic layer having an enhanced thermal conduction in the thickness direction. The recording medium S is then separated from the fixing belt by a separation member 25, and transported.

(6-2) Fixing Belt-Pressure Roller Type Heat Fixing Apparatus

Figure 9:
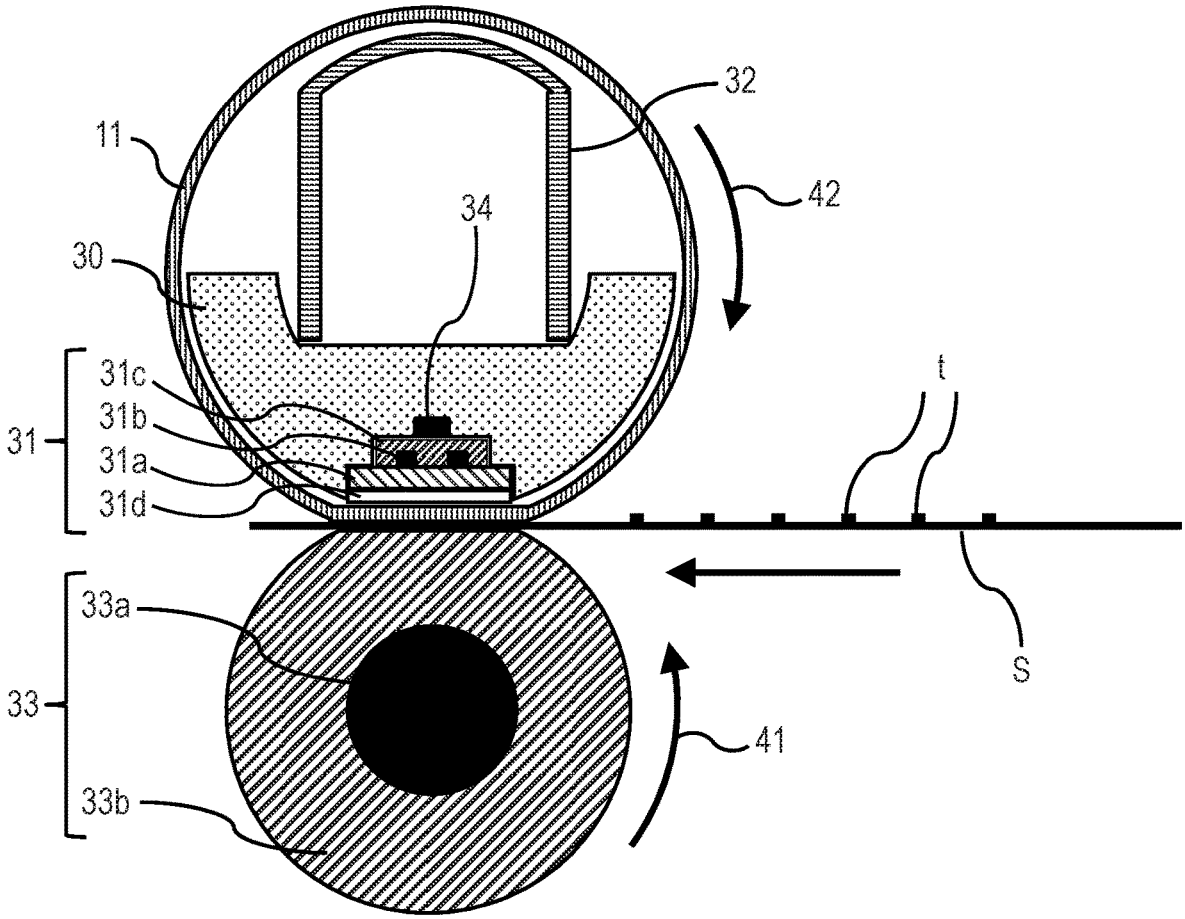
FIG. 9 is a cross-sectional view illustrating a heat fixing apparatus in another aspect of the present disclosure.

FIG. 9 is a schematic view illustrating an example of the fixing belt-pressure roller type heat fixing apparatus using a ceramic heater as heating unit. In FIG. 9, a fixing belt 11 is in a cylindrical shape or endless shape, and one described above or the like is used. A belt guide 30 having heat resistance and thermal insulation properties is used for holding the fixing belt 11. At a location where the belt guide 30 comes into contact with the fixing belt 11 (approximately center of lower face of belt guide 30), a ceramic heater 31 for heating the fixing belt 11 is fitted in a groove formed along the longitudinal direction of the guide to be fixed and supported. The fixing belt 11 is loosely fitted around the belt guide 30. A rigid stay 32 for applying pressure is inserted inside the belt guide 30.

Under the fixing belt 11, a pressure roller 33 opposed to the fixing belt 11 is disposed. The pressure roller is an elastic pressure roller including a core metal 33*a* with an elastic layer 33*b* made of silicone rubber to lower the hardness, in the present example. Such an elastic pressure roller is disposed with both ends of the core metal 33*a* rotatably held between a front chassis side plate and a back chassis side plate not shown in drawing of the apparatus with a bearing. The elastic pressure roller is coated with a PFA (tetrafluoroethylene/perfluoroalkyl ether copolymer) tube to improve the surface properties.

Between both ends of the rigid stay 32 for applying pressure and a spring receiving member (not shown in drawing) adjacent to the chassis of the apparatus, pressure springs (not shown in drawing) are contractedly disposed, respectively, so as to apply pressing down force to the rigid stay 32 for applying pressure. Thereby, the lower face of the ceramic heater 31 disposed on the lower face of the belt guide 30 made of heat resistant resin and the upper face of the pressure roller 33 are pressure contacted across the fixing belt 11 to form the fixing nip part N.

The pressure roller 33 is rotary driven in the counter-clockwise direction illustrated by an arrow 41 by a driving unit not shown in drawing. A rotational force is applied to the fixing belt 11 by the frictional force between the rotary driven pressure roller 33 and the outer face of the fixing belt 11. The fixing belt 11 rotates around the belt guide 30 in the clockwise direction shown by an arrow 42 at a circumferential velocity approximately corresponding to the rotational circumferential velocity of the pressure roller 33, while the inner surface thereof sliding in contact with the lower face of the ceramic heater 31 at the fixing nip part N.

(Pressure Roller Driving Method)

Based on the printing start signal, the rotation of the pressure roller 33 is initiated, and heating up of the ceramic heater 31 is also initiated. Then, at a predetermined moment, the recording medium S supporting the unfixed toner image t as material to be heated is introduced between the fixing belt 11 and the pressure roller 33 of the fixing nip part N, with the toner image supporting face facing the fixing belt 11. The predetermined moment means the moment when the temperature of a temperature detecting device 34 disposed on the top face of the ceramic heater reaches a predetermined temperature, for example, 180° C., resulting from the steady rotational circumferential velocity of the fixing belt 11 rotated by the pressure roller 33. The recording medium S in close contact with the lower face of the ceramic heater 31 through the fixing belt 11 at the fixing nip part N moves and passes through the fixing nip part N together with the fixing belt 11. In the moving and passing process, the heat of the fixing belt 11 is imparted to the recording medium S, so that the toner image t is fixed by heat on the face of the recording medium S. After passing through the fixing nip part N, the recording medium S is separated from the outer face of the fixing belt 11 and transported.

The ceramic heater 31 as heating unit is a linear and horizontal heating unit having a low heat capacity, with the longitudinal direction being orthogonal to the moving direction of the fixing belt 11 and the recording medium S. It is preferable that the ceramic heater 31 have a fundamental structure including a heater substrate 31*a* made of aluminum nitride or the like, a heating layer 31*b* disposed on the surface of the heater substrate 31*a* along the longitudinal direction, and a protective layer 31*c* made of glass, fluorine resin, or the like further disposed thereon. It is preferable that the heating layer 31*b* include, for example, a coating of an electrically resistive material such as Ag/Pd (silver/palladium) having a thickness of about 10 μm, a width of 1 to 5 mm provided by screen printing or the like. The ceramic heater is not limited to such ones.

By the electrical conduction between both ends of the heating layer 31*b* of the ceramic heater 31, the heating layer 31*b* produces heat, so that the temperature of the heater 31 rises rapidly.

The ceramic heater 31 fitted in a groove formed at approximately center of lower face of the belt guide 30 along the longitudinal direction of the guide is fixed and supported, with the protective layer 31*c* facing up. At the fixing nip part N in contact with the fixing belt 11, the face of the sliding member 31*d* of the ceramic heater 31 and the inner circumferential surface of the fixing belt 11 come into contact each other and slide.

As described above, in the heat fixing apparatus that uses the fixing belt 11 in the present disclosure as heating belt, the heat supplied to the fixing belt by a heating unit (heater) disposed in contact with the inner circumferential surface of the fixing belt tends to flow in the circumferential direction and the thickness direction of the elastic layer. As a result, the occurrence of gloss step in the electrophotographic image resulting from the temperature difference of the fixing member between the first cycle and the second cycle can be suppressed and the heat can be efficiently used for the heat fixing of the unfixed toner.

According to an aspect of the present disclosure, a fixing member for heat fixing apparatus capable of preventing occurrence of gloss step in an electrophotographic image caused by temperature difference of the fixing member between a first cycle and a second cycle can be obtained, while suppressing reduction in the usage efficiency of heat. Further, according to another aspect of the present disclosure, a heat fixing apparatus capable of forming a high-quality electrophotographic image can be obtained.

EXAMPLES

The present disclosure is described in more detail with reference to Examples as follows.

Example 1

(1) Preparation of Addition Curing Liquid Silicone Rubber Composition

First, as component a, 98.6 pts. mass of a silicone polymer having a vinyl group as unsaturated aliphatic group at both end of a molecular chain only, and a methyl group as unsaturated hydrocarbon group containing no other unsaturated aliphatic group was prepared. Hereinafter, the silicone polymer (trade name: DMS-V35, manufactured by Gelest, Inc., viscosity: 5000 $mm^2/s$) is referred to as "Vi".

Subsequently, to the Vi, 80 pts. mass of hexagonal boron nitride (trade name: SGP, manufactured by Denka Co., Ltd.) as thermally conductive filler was added and sufficiently mixed to obtain a mixture 1.

Subsequently, into the mixture 1, 0.2 pts. mass of 1-ethynyl-1-cyclohexanol (manufactured by Tokyo Chemical Industry Co., Ltd.) as component d, which is a curing retarder, dissolved in the same amount of toluene was added to obtain a mixture 2.

Subsequently, into the mixture 2, 0.1 pts. mass of hydrosilylation catalyst (platinum catalyst: mixture of platinum 1,3-divinyltetramethyldisiloxane complex, 1,3-divinyltetramethyldisiloxane, and 2-propanol) as component c was added to obtain a mixture 3.

Further, 1.4 pts. mass of silicone polymer having a straight chain siloxane skeleton and an active hydrogen group bonded to silicon in a side chain only (trade name: HMS-301, manufactured by Gelest, Inc., viscosity: 30 $mm^2/s$, hereinafter, referred to as "SiH") as component b was weighed. The component b was added to the mixture 3 and sufficiently mixed to obtain an addition curing liquid silicone rubber composition.

The content ratio of hexagonal boron nitride (filler) in the silicone rubber composition was 25 vol % based on the total volume of the elastic layer.

(2) Preparation of Fixing Belt

An endless belt made of electrocast nickel having an inner diameter of 55 mm, a width of 420 mm, and a thickness of 65 μm was prepared as a substrate. In the series of production steps, the endless belt with a core cylinder inserted inside was handled.

The outer circumferential surface of the substrate was coated approximately uniformly with a primer (trade name: DY39-051A/B, manufactured by Dow Corning Toray Co., Ltd.) to have a dry weight of 50 mg. After the solvent was dried, baking was performed in an electric furnace set at 160° C. for 30 minutes. Onto the primer-treated substrate, the addition curing liquid silicone rubber composition prepared as described above was applied by a ring coating method, so that a layer of the addition curing liquid silicone rubber composition having a thickness of 450 μm was formed. The product is referred to as uncured endless belt.

Subsequently, a corona charger was disposed oppositely along the generating line of the uncured endless belt. While rotating the uncured endless belt at 100 rpm, an AC electric field was applied to the surface of the elastic layer before curing to charge the outer surface of the layer of the addition curing liquid silicone rubber composition. As the electric field application conditions, the supply current to discharge wire of the corona charger was set to ±150 μA, the grid electrode potential to ±1500 V (Vp-p: 3000 V), the frequency to 0.025 Hz, the charging time to 160 seconds, and the distance between grid electrode and belt to 3 mm.

The charged uncured endless belt placed in an electric furnace was heated at 160° C. for 1 minute (primary curing), and further heated at 200° C. for 30 minute (secondary curing). Thereby, the layer of addition curing liquid silicone rubber composition was cured, so that an elastic layer was formed.

Subsequently, the surface of the elastic layer was coated approximately uniformly as an adhesive layer with an addition curing silicone rubber adhesive (trade name: SE1819CV A/B, manufactured by Dow Corning Toray Co., Ltd.) to have a thickness of about 20 μm. On to the coating, a fluorine resin tube having an inner diameter of 52 mm and a thickness of 40 μm (trade name: NSE, manufactured by Gunze Ltd.) was laminated as releasing layer while expanding the diameter. Then, by ironing the belt surface uniformly from above the fluorine resin tube, surplus adhesive between the elastic layer and the fluorine resin tube was ironed out, such that the adhesive had a thinned thickness of about 5 μm.

The endless belt was heated in an electric furnace set at 200° C. for 1 hour to cure the adhesive, so that the fluorine resin tube was fixed on the elastic layer. Both ends of the resulting endless belt were cut to obtain a fixing belt having a width of 368 mm.

(3) Characterization of Fixing Belt (3-1) Thermal Conductivity of Elastic Layer in Thickness Direction The thermal conductivity of the elastic layer in the thickness direction λnd was calculated from the following equation.

$$\lambda nd = \alpha \times C_p \times \rho$$

wherein λnd represents thermal conductivity (W/(m·K)) in thickness direction of elastic layer, α represents thermal diffusivity ($m^2/s$) in thickness direction, $C_p$ represents isobaric specific heat (J/(kg·K)), and ρ represents density ($kg/m^3$).

The values of thermal diffusivity in the thickness direction α, the isobaric specific heat $C_p$, and the density ρ were obtained by the following methods.

Thermal Diffusivity α

The thermal diffusivity in the thickness direction α of the elastic layer was measured using a periodic heating type thermophysical property measuring apparatus (trade name: FTC-1, manufactured by Advance Rico Inc.) at room temperature (25° C.). From the elastic layer, 5 rectangular sample pieces in total, each having a short side of 8 mm and a long side of 12 mm, were cut out with a cutter. The thickness of each of the sample pieces was measured with the following digital length measuring instrument.

Digital length measuring instrument: trade name: DIGIMICRO (registered trademark) MF-501, flat probe with a diameter of 4 mm, manufactured by Nikon Corporation.

Subsequently, the thermal diffusivity α of each of the sample pieces was measured 5 times in total to obtain an average ($m^2/s$). Incidentally, during measurement, the sample piece was pressurized with a weight of 1 kg.

As a result, the thermal diffusivity in the thickness direction α of the elastic layer of silicone rubber was $7.95\times10^{-7}$ $m^2/s$.

Isobaric Specific Heat $C_p$

The isobaric specific heat of the elastic layer was measured by using a differential scanning calorimeter (trade name: DSC823e, manufactured by Mettler-Toledo Inc.).

Specifically, aluminum pans were used as a pan for samples and a pan for reference.

First, as blank measurement was performed with both pans in an empty state, based on a program for keeping temperature constant at 15° C. for 10 minutes, then raising temperature to 215° C. at a heating rate of 10° C./minute, and keeping temperature constant at 215° C. for further 10 minutes. Subsequently, using 10 mg of synthesized sapphire having a known isobaric specific heat as reference material, the measurement was performed based on the same program. Subsequently, 10 mg of the measurement sample, which is the same amount of the synthesized sapphire as reference material, was cut out from the elastic layer and then set on the pan for samples. The measurement was performed based on the same program. The measurement results were analyzed using a specific heat analysis software attached to the differential scanning calorimeter. Based on the average of the 5 measurement results, the isobaric specific heat $C_p$ at 25° C. was calculated.

As a result, the isobaric specific heat of the silicone rubber elastic layer was 1.27 J/(g·K).

Density ρ

The density of the elastic layer was measured by using a dry automatic densimeter (trade name: Accupyc 1330-01, manufactured by Shimadzu Corporation). Specifically, a sample cell having a cell volume 10 $cm^3$ was used. A sample piece was cut out from the elastic layer such that about 80% of the cell volume was filled. After the mass of the sample piece was measured, the sample piece was placed in the sample cell. The sample cell was set in the measurement part in the apparatus. Helium was used as measurement gas. After purging with the gas, the volume measurement was performed 10 times. For each time, from the mass and the measured volume of the sample piece, the density of the elastic layer was calculated. The average thereof was then obtained.

As a result, the density of the silicone rubber elastic layer was 1.29 $g/cm^3$.

Based on the isobaric specific heat $C_p$ (J/(kg·K)) with unit conversion, density ρ ($kg/m^3$), and measured thermal diffusivity α ($m^2/s$) of the elastic layer, the thermal conductivity of the elastic layer in the thickness direction λnd was calculated to be 1.40 W/(m·K).

(3-2) Thermal Conductivity of Elastic Layer in the Longitudinal Direction and Circumferential Direction The thermal conductivity of elastic layer in the longitudinal direction λmd and the thermal conductivity in the circumferential direction λtd were calculated from the following equations.

$$\lambda md = \alpha md \times C_p \times \rho$$

$$\lambda td = \alpha td \times C_p \times \rho$$

wherein αmd represents thermal diffusivity in the width direction ($m^2/s$), αtd represents thermal diffusivity in the circumferential direction ($m^2/s$), $C_p$ represents isobaric specific heat (J/(kg·K)), and ρ represents density ($kg/m^3$).

For the isobaric specific $C_p$ and the density ρ, the values obtained by the methods described above were used, while the thermal diffusivity in the longitudinal direction αmd and the thermal diffusivity in the circumferential direction αtd were obtained by the following method.

The measurement was performed at room temperature (25° C.), by using an optical AC thermal diffusivity measurement apparatus (trade name: Laser PIT, manufactured by Advance Rico Inc.). First, a sample piece having a short side of 5 mm and a long side of 30 mm was cut out with a cutter, such that the elastic layer sample had a length of 30 mm in the longitudinal direction or the circumferential direction.

Subsequently, on the surface of the sample piece, a black coating material (trade name: JSC-No. 3, manufactured by Japan Sensor Corporation) was applied, and baked in an electric furnace set at 150° C. for 20 minutes. Each of the samples thus prepared was subjected to measurement twice under the following conditions to obtain an average thereof. The measurement was performed under conditions at room temperature and reduced pressure, with a total measurement time of 1500 seconds, two times sampling, a period (1/frequency) of 5, a rate (moving velocity of sample mounting base) of 10 μm/s, and a level (moving distance of sample mounting base) of 3000 μm.

Based on the isobaric specific heat Cp (J/(kg·K)), density ρ ($kg/m^3$) of the elastic layer and the measured thermal diffusivities αmd ($m^2/s$) and αtd ($m^2/s$), the thermal conductivity of the elastic layer in longitudinal direction λmd and the thermal conductivity in circumferential direction λtd were calculated. The results were as follows: λmd=1.94 W/(m·K), and λtd=2.47 W/(m·K).

(3-3) Elastic Modulus of Elastic Layer

The tensile elastic modulus of the elastic layer was measured. Specifically, the elastic layer sample was cut out with a punching die (JIS K6251, tensile No. 8 dumbbell shape) to measure the thickness of the sample piece in the vicinity of the center as the measurement spot. Subsequently, the cut out sample was tested at a tension rate of 200 mm/minute at room temperature using a tensile tester (apparatus name: Strograph EII-L1, manufactured by Toyo Seiki Seisaku-sho Ltd.). The tensile elastic modulus was determined as follows. From the measurement results, a graph was made with the horizontal axis corresponding to the strain of the sample piece and the vertical axis corresponding the tensile stress. In a strain range of 0 to 10%, the measurement data were subjected to linear approximation. The slope of the approximated line was defined as the tensile elastic modulus.

(4) Pilot Experiment (Fixing Properties, Image Quality and Durability)

<Evaluation on Fixing Properties (Fixing Properties)>

The fixing belt thus obtained was incorporated into a heat fixing apparatus of an electrophotographic copier (trade name: imagePRESS C850 manufactured by Canon Inc). The heat fixing apparatus was installed on the copier. By using the copier, a solid cyan image was formed on a cardboard having a basis weight of 300 $g/m^2$ (trade name: UPM Finesse gloss 300 g/m2, manufactured by UPM), at a fixing temperature set lower than the standard fixing temperature.

Specifically, with the fixing temperature of the heat fixing apparatus adjusted to the standard fixing temperature of the copier of 195° C. to 185° C., 5 solid cyan images were successively formed, and the fifth solid image was subjected to the measurement of image density. Subsequently, the toner face of the solid image was rubbed with a sheet of lens-cleaning paper with a load of 4.9 kPa (50 $g/cm^2$) applied three times in the same direction. After rubbing, the image density was measured. In the case where the lowering rate of the image density through rubbing (=[Difference in image density before and after rubbing/Image density before rubbing]×100) was less than 5%, it was determined that the toner was fixed to the cardboard.

Further, the fixing state of the toner to the cardboard was evaluated in the same manner as the above, except that the fixing temperature was adjusted to 180° C.

The results were evaluated based on the following criteria. The image density was measured using a reflection densitometer (manufactured by Macbeth Co., Ltd.).

Rank A: Toner was fixed on the cardboard at a fixing temperature of 180° C. Rank B: Although toner was not fixed on the cardboard at a fixing temperature of 180° C., toner was fixed on the cardboard at a fixing temperature of 185° C.

Rank C: Toner was not fixed on the cardboard even at a fixing temperature of 185° C.

<Evaluation on Image Quality (Image Quality)>

A fifth solid image prepared in the evaluation on fixing properties was visually observed. The degree of gloss step between the trailing end on the first cycle and the leading end on the second cycle was evaluated by visual inspection and by using a gloss meter (PG-1 manufactured by Nippon Denshoku Industries Co., Ltd.) based on the following criteria.

Rank A: No gloss step was identified. In other words, the 60° gloss difference between the trailing end on the first cycle and the leading end on the second cycle was Δ0.

Rank B: Slight gloss difference was identified. The 60° gloss difference between the trailing end on the first cycle and the leading end on the second cycle was more than Δ0 and less than Δ2.

Rank C: Gloss difference was identified. The 60° gloss difference between the trailing end on the first cycle and the leading end on the second cycle was Δ2 or more.

<Evaluation on Durability (Durability)>

In a state with a fixing temperature set to the standard fixing temperature (195° C.), a solid cyan image was successively formed on a sheet of A4 plain paper. At the time when breakage or plastic deformation occurred in the elastic layer of the fixing belt, the number of sheets was recorded and evaluation was performed based on the following criteria. In the case where no breakage or plastic deformation occurred in the elastic layer aaaof the fixing belt even when the number of sheets of the image reached 740000, the image formation was suspended at the 740000th sheet.

Rank A: No breakage or plastic deformation occurred in the elastic layer of the fixing belt even through image formation on 740000 sheets.

Rank B: Although no breakage or plastic deformation occurred in the elastic layer of the fixing belt even through image formation on 300000 sheets, breakage or plastic deformation occurred in the elastic layer of the fixing belt through image formation on 740000 sheets.

Rank C: Although no breakage or plastic deformation occurred in the elastic layer of the fixing belt even through image formation on 100000 sheets, breakage or plastic deformation occurred in the elastic layer of the fixing belt through image formation on 300000 sheets.

Example 2

A fixing belt was prepared and evaluated in the same manner as in Example 1, except that the volume ratio of hexagonal boron nitride was set to 20 vol %.

Example 3

A fixing belt was prepared and evaluated in the same manner as in Example 1, except that the volume ratio of hexagonal boron nitride was set to 20 vol %, and 3 vol % of spherical alumina (trade name: CB-P02, manufactured by Showa Denko K. K.) was used as another filler.

Example 4

A fixing belt was prepared and evaluated in the same manner as in Example 1, except that the volume ratio of hexagonal boron nitride was set to 25 vol %, and 3 vol % of spherical alumina (trade name: CB-P02, manufactured by Showa Denko K. K.) was used as another filler.

Example 5

A fixing belt was prepared and evaluated in the same manner as in Example 1, except that the volume ratio of hexagonal boron nitride was set to 30 vol %.

Comparative Example 1

A fixing belt was prepared and evaluated in the same manner as in Example 1, except that no charge was imparted to the surface of the layer of addition curing liquid silicone rubber composition.

Comparative Example 2

A fixing belt was prepared and evaluated in the same manner as in Example 1, except that the grid electrode potential was changed to ±200 V (Vp-p: 400 V).

Comparative Example 3

A fixing belt was prepared and evaluated in the same manner as in Example 1, except that the volume ratio of hexagonal boron nitride was set to 18 vol %.

Comparative Example 4

An addition curing liquid silicone rubber composition was prepared in the same manner as in Example 1, except that the volume ratio of hexagonal boron nitride of filler was set to 33 vol %. However, the resulting addition curing liquid silicone rubber composition had a high viscosity, so that it was difficult to form the elastic layer of the fixing belt by a ring coating method.

Comparative Example 5

The hexagonal boron nitride was replaced with a cubic boron nitride (trade name: SGPS, manufactured by Denka Co., Ltd.). Further, no charge was imparted to the surface of the layer of addition curing liquid silicone rubber composition.

Except for the above, a fixing belt was prepared and evaluated in the same manner as in Example 1.

Comparative Example 6

A fixing belt was prepared and evaluated in the same manner as in Example 1, except that the hexagonal boron nitride was replaced with a cubic boron nitride (trade name: SGPS, manufactured by Denka Co., Ltd.).

Comparative Example 7

The hexagonal boron nitride was replaced with spherical alumina (trade name: CB-P10, manufactured by Showa Denko K. K.), and the content thereof was set to 57 vol %. Further, no charge was imparted to the surface of the layer of addition curing liquid silicone rubber composition. Except for the above, a fixing belt was prepared and evaluated in the same manner as in Example 1.

The results described above are shown in Table 1.

TABLE 1

| | | Filler | | | | Electrode potential | λtd |
|---|---|---|---|---|---|---|---|
| | | Type | Vol % | Type | Vol % | kV | W/(m · K) |
| Example | 1 | Hexagonal boron nitride | 25 | — | — | 1.5 | 2.47 |
| | 2 | Hexagonal boron nitride | 20 | — | — | 1.5 | 2.10 |
| | 3 | Hexagonal boron nitride | 20 | Spherical alumina | 3 | 1.5 | 2.21 |
| | 4 | Hexagonal boron nitride | 25 | Spherical alumina | 3 | 1.5 | 2.49 |
| | 5 | Hexagonal boron nitride | 30 | — | — | 1.5 | 2.01 |
| Comparative Example | 1 | Hexagonal boron nitride | 25 | — | — | Untouched | 2.07 |
| | 2 | Hexagonal boron nitride | 25 | — | — | 0.2 | 2.00 |
| | 3 | Hexagonal boron nitride | 18 | — | — | 1.5 | 2.00 |
| | 4 | Hexagonal boron nitride | 33 | — | — | Not formable | |
| | 5 | Cubic boron nitride | 25 | — | — | Untouched | 0.62 |
| | 6 | Cubic boron nitride | 25 | — | — | 1.5 | 0.63 |
| | 7 | Spherical alumina | 57 | — | — | Untouched | 1.57 |

TABLE 1-continued

| | | λmd W/(m · K) | λnd W/(m · K) | Elastic modulus of elastic layer (MPa) | Fixing properties | Image quality | Durability |
|---|---|---|---|---|---|---|---|
| Example | 1 | 1.94 | 1.40 | 0.49 | A | A | A |
| | 2 | 1.85 | 1.38 | 0.30 | A | A | A |
| | 3 | 1.91 | 1.40 | 0.37 | A | A | A |
| | 4 | 2.01 | 1.42 | 0.53 | A | A | A |
| | 5 | 1.96 | 1.31 | 0.59 | B | A | B |
| Comparative Example | 1 | 1.80 | 0.56 | 0.42 | C | B | A |
| | 2 | 1.78 | 1.00 | 0.42 | C | B | A |
| | 3 | 1.81 | 0.90 | 0.26 | C | B | B |
| | 4 | | | Not formable | | | |
| | 5 | 0.68 | 0.62 | 0.39 | C | C | A |
| | 6 | 0.69 | 0.60 | 0.41 | C | C | A |
| | 7 | 1.51 | 1.51 | 1.03 | A | B | C |

In all of Examples, the total amount of fillers compounded is 30 vol % or less, and the following relation is satisfied: λtd>λmd>λnd, wherein λtd is 2.0 W/(m·K) or more, and λnd is 1.3 W/(m·K) or more. Thereby, the fixing properties, the gloss step, and the durability were evaluated as rank A or rank B, which are good results. In particular, in Examples 1 to 4, where the content of hexagonal boron nitride filler is 20 vol % or more and 25 vol % or less, any of the evaluation indicators was rank A.

On the other hand, in Comparative Examples, the amount of fillers compounded and the thermal conductivity were out of the ranges described above, and any one of the items were evaluated as rank C.

Although the fixing belt was described in Examples and Comparative Examples, it is easily understood that the fixing roller has the same tendency.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-070450, filed Apr. 19, 2021, and Japanese Patent Application No. 2022-039849, filed Mar. 15, 2022, which are hereby incorporated by reference herein in their entirety.

What is claimed is:

1. A fixing member for electrophotography having an endless shape comprising:

a base layer having an endless shape, and an elastic layer on an outer circumferential surface of the base layer, the elastic layer including a silicone rubber and a filler dispersed in the silicone rubber, wherein a content of the filler in the elastic layer is 30 vol % or less with respect to a volume of the elastic layer, wherein the elastic layer satisfies following relation:

$$\lambda td>\lambda md>\lambda nd,$$

where λtd is a thermal conductivity of the elastic layer in a circumferential direction, λnd is a thermal conductivity of the elastic layer in a thickness direction, and λmd is a thermal conductivity of the elastic layer in a longitudinal direction, and wherein λtd is 2.0 W/(m·K) or more, and λnd is 1.3 W/(m·K) or more.

2. The fixing member according to claim 1, further comprising a surface layer on an outer circumferential surface of the elastic layer.

3. The fixing member according to claim 1, wherein the filler comprises hexagonal boron nitride.

4. The fixing member according to claim 3, wherein a content of the hexagonal boron nitride is 20 vol % to 25 vol % based on a volume of the elastic layer.

5. The fixing member according to claim 1, wherein the elastic layer has an elastic modulus of 0.20 MPa to 1.20 MPa.

6. The fixing member according to claim 1, wherein the fixing member is a fixing belt having an inner diameter of 20 mm to 130 mm.

7. A heat fixing apparatus comprising a heating member and a pressurizing member disposed opposed to the heating member, wherein the heating member is a fixing member, the fixing member comprising:

a base layer having an endless shape, and an elastic layer on an outer circumferential surface of the base layer, wherein the elastic layer includes a silicone rubber and a filler dispersed in the silicone rubber, wherein a content of the filler in the elastic layer is 30 vol % or less based on a volume of the elastic layer, wherein the elastic layer satisfies following relation:

$$\lambda td>\lambda md>\lambda nd,$$

where λtd is a thermal conductivity of the elastic layer in a circumferential direction, λnd is a thermal conductivity of the elastic layer in a thickness direction, and λmd is a thermal conductivity of the elastic layer in a longitudinal direction, and wherein λtd is 2.0 W/(m·K) or more, and λnd is 1.3 W/(m·K) or more.

8. A heat fixing apparatus comprising a heating member, a pressurizing member disposed opposed to the heating member, and a heater for heating the heating member, wherein the heating member is the fixing member according to claim 6, and the heater is disposed in contact with an inner circumferential surface of a substrate of the fixing member.

* * * * *